United States Patent [19]

Lendermon et al.

[11] Patent Number: 4,744,424

[45] Date of Patent: May 17, 1988

[54] SHAPED CHARGE PERFORATING APPARATUS

[75] Inventors: Gary M. Lendermon, Missouri City; Jack F. Lands, Jr., West Columbia, both of Tex.

[73] Assignee: Schlumberger Well Services, Houston, Tex.

[21] Appl. No.: 898,962

[22] Filed: Aug. 21, 1986

[51] Int. Cl.[4] ..... E21B 43/117

[52] U.S. Cl. ..... 175/4.51; 175/4.6

[58] Field of Search ..... 175/2, 4.51, 4.6; 160/55, 55.1

[56] References Cited

U.S. PATENT DOCUMENTS

| | | | |
|---|---|---|---|
| 3,036,521 | 5/1962 | Owen | 175/4.6 |
| 3,100,443 | 8/1963 | Pohoriles | 175/451 |
| 4,375,834 | 3/1983 | Trott | 175/4.51 |
| 4,523,649 | 6/1985 | Stout | 175/4.51 |
| 4,598,775 | 7/1986 | Vann et al. | 175/4.6 |

*Primary Examiner*—Stephen J. Novosad
*Assistant Examiner*—William P. Neuder

[57] ABSTRACT

In the representative embodiment of the new and improved perforating apparatus described herein, shaped charge cases are provided with matching upper and lower supports with parallel abutment surfaces and alignment means cooperatively arranged to enable a plurality of these charge cases to be stacked together for erecting an intertwined assembly of cases. By appropriately selecting the combined heights of the matching supports, adjacent ones of the charge cases can be closely spaced one above the other and directed outwardly along selected radial perforating axes at uniform angular spacings.

21 Claims, 3 Drawing Sheets

FIG. 4
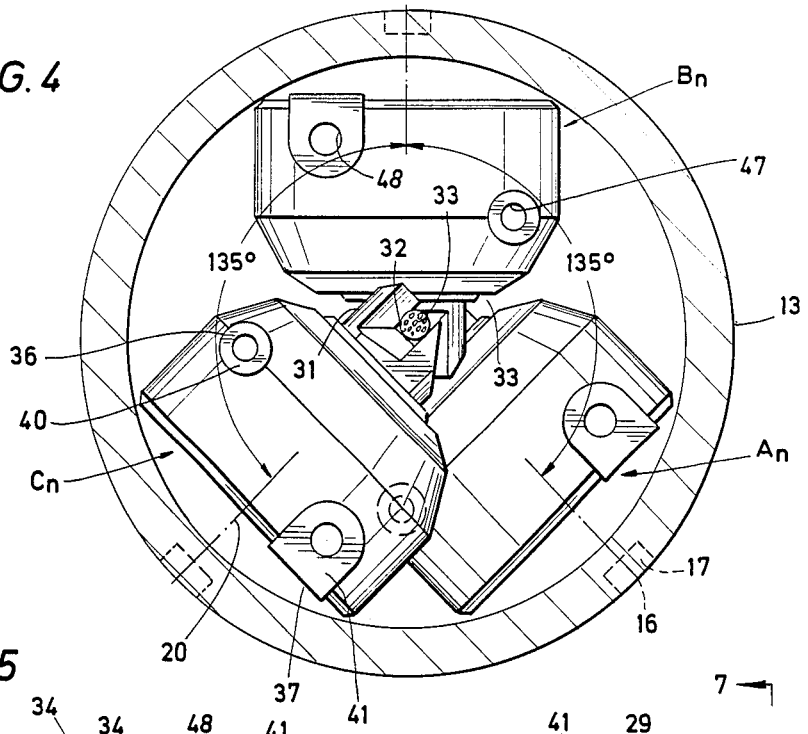
FIG. 5
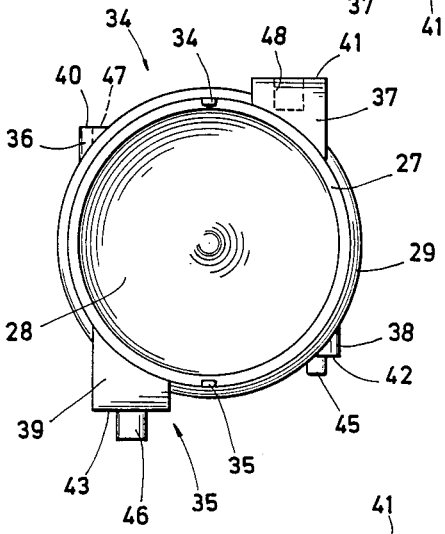
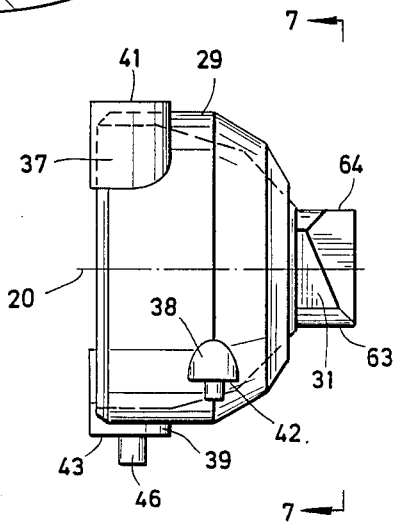
FIG. 6
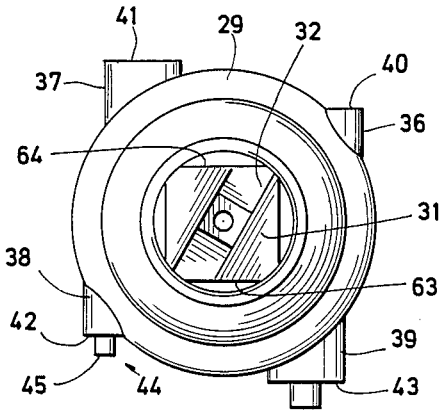
FIG. 7

SHAPED CHARGE PERFORATING APPARATUS

FIELD OF THE INVENTION

This invention relates to new and improved well bore perforating apparatus operatively arranged to be dependently suspended in a well bore and selectively operated for producing multiple perforations in a cased well bore. More particularly, this invention involves new and improved perforating appartus including a plurality of uniquely-interfitting shaped explosive charges adapted to be assembled together to provide an optimum arrangement of the maximum number of the largest possible charges which can be installed in a tubular carrier of a given diameter.

BACKGROUND ART

The typical enclosed expendable perforators which are used for perforating well bores generally utilize an elongated tubular housing or so-called "carrier" in which a plurality of laterally-directed shaped explosive charges are cooperatively mounted at longitudinally spaced intervals. To fire the charges, a length of detonating cord is disposed within the carrier and cooperatively positioned within detonating proximity of the base of each charge and one end of the cord is coupled to a detonator which is appropriately arranged to be selectively actuated from the surface. These enclosed carriers are typically fashioned from steel tubing having a wall thickness sufficient to withstand the extreme pressure conditions ordinarily encountered in most well bores. Once the charges and detonating means have been mounted in the carrier, suitable end closure members or heads are positioned in the opposite ends of the tubular body to block the entrance of well bore fluids into the interior of the carrier.

Those skilled in the art will recognize, of course, that for an enclosed carrier of a given diameter, significantly larger shaped charges can be employed where the charges are inserted into one end of the carrier rather than being installed through lateral ports in the carrier wall. Nevertheless, the typical end-loaded carrier still presents several problems. For instance, steps must be taken to reduce the interference to the perforating jets that takes place as they pass through the wall of the carrier. One common technique involves mounting the charges in the carrier and angularly aligning them so that, when they are detonated, the perforating jet produced by each charge will pass through a small-diameter lateral opening in the carrier wall that is plugged by a thin closure member. As an alternative for these lateral openings and closure members, small-diameter countersunk or blind holes can instead be drilled at appropriate locations in the outer wall of the carrier during its fabrication so as to leave only reduced-thickness wall portions to be penetrated by the perforating jets when the charges are subsequently fired.

Those skilled in the art will, of course, appreciate that regardless of whether thin closures or reduced-thickness wall portions are employed, in either case some provision must be made for installing the shaped charges into the carrier in such a manner that each shaped charge will be accurately aligned with its associated reduced-thickness wall portion. Heretofore, this problem has been resolved by simply mounting the shaped charges intended for a given carrier on an elongated tubular support that is cooperatively arranged to be inserted longitudinally into the carrier and positioned as needed for aligning the several charges with their respective reduced-thickness wall portions. Typically these elongated supports have been fabricated by cutting a series of longitudinally spaced lateral openings in the opposing side walls of elongated metal or plastic tubes which have either a square or circular cross-section of suitable dimensions to snugly fit the internal bore of the carrier body.

These elongated tubular supports have, of course, been generally satisfactory for use in end-loaded carriers where it is considered adequate to mount the charges in the carrier at such typical longitudinal spacings as two or four shaped charges per foot of length of the carrier. With these spacings, the forward and rear portions of the charge cases are retained in the opposed openings in the charge supports and there is sufficient material remaining in a given support tube to keep the charges from being misaligned by rough handling or by impact forces on the carrier as it is being lowered into a well bore. As described in U.S. Pat. No. 3,773,119, for example, support tubes such as these have been successfully used heretofore by forming the supports from tubes of heavy cardboard or fiberglass having sufficient strength for supporting the charge cases during perforating operations as well as by using square tubes that can be easily flattened where necessary to also resolve a shipping or storage problem.

In the past few years it has been found that in some situations it is necessary to significantly increase the number of perforations per foot in a given perforated interval of a well bore. In particular, recent developments in conducting gravelpack operations have made it advantageous to put at least ten or twelve perforations per foot in each well bore interval that is to be gravel packed. Those skilled in the art will realize, of course, that there is a practical limit to the number of shaped charges of a given size that can be mounted in a given length of a typical support tube. For instance, if the overall length of the charges is greater than the radius of the internal bore of the carrier, only one shaped charge can be mounted in any given transverse plane. Conversely, if more than one charge is to be mounted in the same transverse plane, the overall length of each charge is limited to something less than the internal radius of the carrier and the overall performance of these charges will be correspondingly reduced. In any case, it will be recognized that if a typical support tube is to be arranged to carry more than four shaped charges per foot, the overall strength of the tube will be greatly reduced so that it will be difficult to protect these tubes during their shipment and storage. It has also been found that these weaker tubes can be easily damaged by rough handling once the perforator carrier is loaded and is ready for operation.

Other proposals which have been made for installing a large number of shaped charges in an end-loaded carrier involve the use of three or four shaped charges which are loaded in a unitary container and respectively aligned to be fired along a separate perforating axis that is angularly displaced from the perforating axes of the other charges in the same container. A number of these charge clusers are then stacked in a typical end-loaded carrier and cooperatively associated with a detonating cord extending along the central axis of the stacked containers.

Those skilled in the art will, of course, recognize that in addition to the problems mentioned above regarding shaped charges that are positioned in a common transverse plane, there is also a significant reduction in the overall performance of the charges by virtue of the charges being stacked in close proximity to one another. It should also be noted that it is time consuming to install the detonating cord through a large number of charge containers as they are stacked in a carrier; and that it is even more difficult to reload the carrier should it later become necessary either to increase or decrease the number of charges in the carrier or to change the longitudinal spacing between the charges.

OBJECTS OF THE INVENTION

Accordingly, it is an object of the present invention to provide new and improved perforating apparatus having shaped explosive charges which can be quickly and reliably installed as a group in a typical end-loaded carrier and be firmly secured in a precise alignment with their respective port-closure members of reduced-thickness wall portion in the carrier.

SUMMARY OF THE INVENTION

This and other objects of the present invention are attained by cooperatively arranging support means and alignment means on each of a plurality of essentially identically shaped charge cases respectively containing a shaped explosive charge that is adapted to develop a perforating jet along the central longitudinal axis of the charge case. To enable these several charge cases to be fitted together to form a unique assembly that is particularly adapted to be installed into an elongated end-loaded carrier, the support means on each of the charge cases are cooperatively arranged to provide matching upwardly-facing and downwardly-facing abutment surfaces that are respectively lying in parallel transverse planes spatially disposed above and below the central axis of the charge case so that by engaging the upper abutment surface on one side of a first charge case with the lower abutment surface on the other side of a second case as well as engaging the upper abutment surface on the opposite side of the second case with the lower abutment surface on one side of a third case and continuing in this manner, a first group of these serially-arranged charge cases will cooperatively define a first stacked structure that has the central axis of each case in the stack respectively lying in a successively higher transverse plane and angularly oriented in one of at least three selected lateral directions.

By forming each of the cases with a cylindrical forward portion and a frustoconical rearward portion and interfitting the rearward portions of the charges cases together, this first group of charge cases can be assembled with at least second and third groups of serially-arranged identical charge cases whereby the upper abutment surface on one side of the first charge case in the second group is engaged with the lower abutment surface on the otherwise-unsupported one side of the second charge case in the first group of charge cases. In a similar fashion, the upper abutment surface on one side of the first charge case in the third group is engaged with the lower abutment surface on the otherwise-unsupported one side of the second charge case in the second group. To complete this intertwined assembly, the lower abutment on one side of the first charge case in the third group is supported by the upper abutment on the other side of the first charge case in the first group.

To firmly secure the assembled charge cases in their respective positions in this unique assembly, the alignment means on each charge case include matching upper and lower alignment guides that are respectively located on opposite sides of each charge case and cooperatively arranged so that the upper guide on one side of the first charge case in one series of the cases will be operatively associated with the lower alignment guide on the other side of the second case in that series and the upper guide on the opposite side of that second case will also be operatively associated with the lower alignment guide on the one side of the third case in that same series. In this manner, as the several charge cases are cooperatively stacked together and successively aligned with the adjacent charge cases, the several charge cases in this unique stacked assembly will be firmly retained in their respective location in the intertwined stacks so that once the entire assembly is completed, it can be inserted as a unit into one end of an elongated tubular carrier and positioned therein as needed for angularly aligning each of the shaped charges with their respective reduced-thickness wall portion or closure member in the carrier wall.

BRIEF DESCRIPTION OF THE DRAWINGS

The novel features of the present invention are set out with particularity in the appended claims. The invention along with further objects and advantages thereof may, therefore, be best understood by way of the following description of exemplary apparatus employing the principles of the present invention as illustrated in the accompanying drawings in which:

FIG. 4 is a plan view taken along the lines "4—4" in FIG. 1 and depicts the uppermost shaped charges in the new and improved intertwined assembly shown in that drawing; and FIGS. 5, 6 and 7 respectively illustrate the front elevation, the side elevation and the rear elevation of the new and improved shaped charge cases arranged in accordance with the principles of the invention.

DETAILED DESCRIPTION OF A PREFERRED EMBODIMENT

Figure 1:
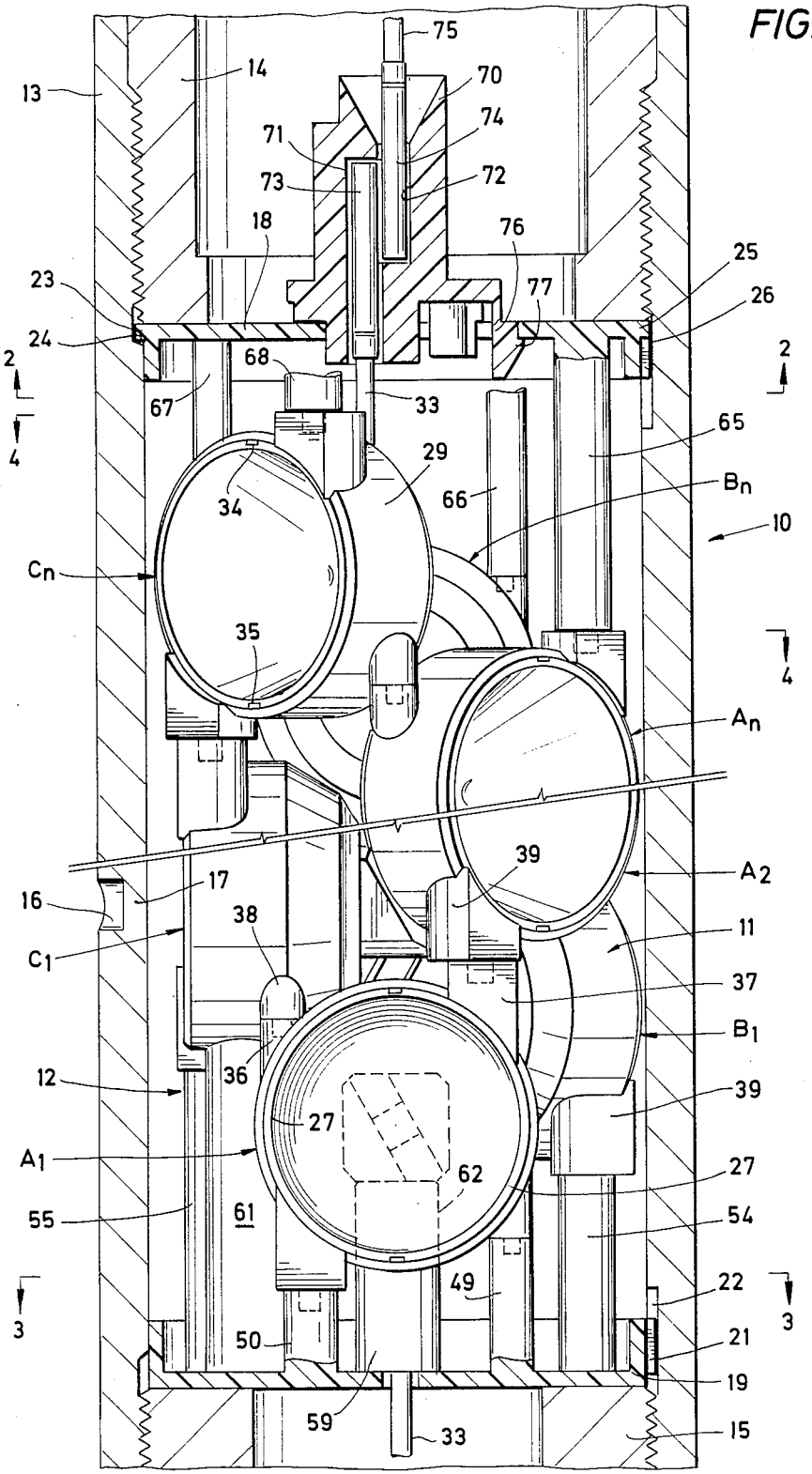
FIG. 1 is an elevational view, partially in cross-section, showing a typical stacked assembly of a plurality of shaped charges respectively disposed in a preferred embodiment of interlocking charge containers arranged in accordance with the principles of the present invention.

Turning now to FIG. 1, an elevational view is shown of perforating apparatus 10 cooperatively arranged in accordance with the principles of the present invention and including a plurality of essentially-identical shaped explosive charges, as shown generally at 11, which have been assembled together into a unique intertwined assembly 12 of the charges that is adapted to be installed into one end of an elongated end-loaded carrier, as at 13, that is then closed at its upper and lower ends by upper and lower head members 14 and 15 of a typical design.

As is common, the new and improved apparatus 10 is appropriately arranged to be dependently suspended at a selected depth in a well bore and thereafter selectively operated for perforating the casing and cement sheath at the selected depth. Those skilled in the art will appreciate that in the practice of the present invention, it is immaterial whether the carrier 13 is cooperatively arranged for connection to the lower end of a suitable suspension cable with electrical conductors such as the perforator depicted, for example, in U.S. Pat. No. 3,773,119 or whether the carrier is alternatively arranged to be connected to the lower end of a tubing string such as the perforator shown in U.S. Pat. No. 4,509,604. In either situation, as explained in more detail in these aforementioned patents (both of which are incorporated herein by reference), once the carrier 13 is positioned adjacent to a given formation interval of interest, it is apparent to one with only ordinary skill in the art how to arrange the new and improved perforating apparatus 10 so it can be selectively actuated whenever desired.

It should be recognized that when the intertwined assembly 12 is installed in the carrier 13, each of the shaped charges 11 must be accurately aligned with its respectively-associated blind bore in the outer wall of the carrier that is terminated by a reduced-thickness wall portion as shown, for example, at 16 and 17 in FIG. 4. Accordingly, as illustrated in FIG. 1, the intertwined assembly 12 is arranged as a unitary stack of the shaped charges 11 which are intercoupled together with the uppermost and lowermost charges in the stack coupled to upper and lower base supports 18 and 19. To correctly position the charges 11 longitudinally with respect to the carrier 13, the upper face of the lower head 15 is arranged to locate the lower base support 19 at the appropriate elevation within the carrier needed to place the central perforating axes, as at 20, of the charges in the same transverse plane as the longitudinal axis of their respective blind bores, as at 16, whenever the intertwined assembly 12 is installed in the carrier. The lower end of the intertwined assembly 12 is also retained in the proper angular alignment with respect to the carrier 13 by means such as a lug or outwardly-projecting finger 21 formed on one side of the lower base support 19 to be biased outwardly into a longitudinal groove 22 in the wall of the lower portion of the carrier. The upper base support 18 is slightly larger in diameter than the lower base support 19 so as to define an enlarged-diameter shoulder 23 that will engage an upwardly-facing shoulder 24 near the upper end of the carrier 13 when the lower base support is resting on the lower head member 15. The upper head 14 for the carrier 13 is cooperatively arranged to engage the upper face of the upper base support 18 so that once the perforating apparatus has been completely assembled, the intertwined assembly 12 is secured against moving longitudinally in relation to the carrier. The upper end of the intertwined assembly 12 is also kept in proper angular alignment relative to the carrier 13 by means such as an outwardly-directed key 25 formed on one side of the upper base support 18 to be received within a complementary inwardly-facing longitudinal groove 26 near the upper end of the carrier.

In the depicted embodiment of the perforating apparatus 10 of the present invention, each shaped charge 11 includes an inner container or hollow case 27 of a suitable metal, such as zinc, which is symmetrically formed about its longitudinal axis 20 to define a frustoconical rearward portion which receives a suitable primer explosive and a cylindrical forward portion which receives a compressed explosive with a forwardly-opening cavity in which a hollow frustoconical metal liner 28 is cooperatively arranged to develop a perforating jet along the central axis of the case. It will, of course, be appreciated that the particular design details of the cases 27 and the explosive components of the charges 11 are outside of the scope of the present invention. In any event, the explosive components of the shaped charges 11 can be selected to have the performance characteristics believed necessary for a given perforating operation.

Regardless of the particular operating characteristics required for a given set of the shaped charges 11, the inner charge cases 27 are respectively mounted within complementally-shaped hollow containers or outer cases, as at 29, which, in the illustrated embodiment of the present invention, are preferably made from a suitable high-strength thermoplastic material that enables the cases to be economically fabricated by means such as an appropriate injection molding process. Although it has been found that a preferred material for these outer containers 29 as well as the upper and lower base supports 18 and 19 is a glass-filled nylon such as presently marketed by the DuPont Corporation under the trademark of "Zytel", those skilled in the art will recognize that other plastics with similar high-temperature and high-strength characteristics may also be used for fabricating the outer cases 29 as well as the base supports 18 and 19.

As illustrated in FIG. 1, it will be appreciated that by virtue of the unique configuration of the several outer cases, as at 29, the intertwined assembly 12 is comprised of a first stacked structure of serially-arranged cases, as shown at A1, A2 . . . An, a second stacked structure formed with other serially-arranged cases, as shown at B1, B2 . . . Bn, as well as a third stacked structure of still another group of serially-arranged charge cases, as shown at C1 . . . Cn−1 and Cn.

As previously mentioned, the intertwined assembly 12 further includes the upper and lower base supports 18 and 19 which are respectively coupled to the upper and lower ends of the interlocking stacked structures A, B and C to give additional strength to the entire assembly. It should be recognized from FIG. 1 that the cases 29 in a given group of serially-arranged cases are also respectively angularly displaced by an angle of 45-degrees in relation to the other outer cases immediately above and below that case. As a result of this angular displacement, the frustoconical rearward portion of an outer case, such as at B1 in the stacked structure B, can be readily disposed within the interstitial spaces defined between two adjacent cases such as A1 and A2 in the stacked structure A. Similarly, the frustoconical rearward portions of the outer cases, such as at C1, can also be cooperatively disposed within the irregular interstitial space respectively defined by the cases A1, A2 and B1.

It will be noted from FIG. 4 that when the outer cases 29 are stacked together to arrange the intertwined assembly 12, the rear faces of the frustoconical rearward portions of the outer cases cooperate to define an axial passage, as at 30, which has a generally-triangular cross-section and extends through the intertwined assembly. As seen in FIGS. 4 and 6, the rearward portions of the inner charge cases 27 are preferably arranged to define an axial projection, as at 31, which is sized to extend through an opening in the rear of each of the outer cases 29 into the axial passage 30 of the intertwined assembly 12. As is typicaly, rearwardly-opening slots, as at 32, are cooperatively arranged transversely across the projections 31 and appropriately shaped to snugly receive the adjacent portion of a detonating cord 33 passing through the axial passage 30. To position the detonating cord 33 within detonating proximity of the primer explosive within each shaped charge 11, the inner cases 27 are fabricated either with a hole in the wall between the primer and the detonating cord or by sufficiently reducing the thickness of this wall so as to achieve high-order detonation of the charge. As illustrated in FIG. 7, it will be noted that the slots 32 are preferably cut at an angle of 26.5-degrees from the vertical so that the detonating cord 33 will follow a somewhat convoluted or zig-zagging path through the center passage 30 in the intertwined assembly 12. To maintain the inner cases 27 in proper angular alignment with respect to the outer cases 29, retaining means such as longitudinal keys and grooves, as at 34 and 35, are cooperatively arranged on the forward portions of the inner and outer cases and adapted to be mated together when the inner cases are fitted into the outer cases as the perforating apparatus 10 is being assembled.

Turning now to FIGS. 5–7 showing elevational views of a preferred embodiment of the outer cases 29 of the invention, it will be noted that each of the outer cases 29 is provided with upper and lower support means 34 and 35 cooperatively arranged to provide upwardly-facing and downwardly-facing abutment surfaces which respectively lie in parallel transverse planes spatially disposed above and below the central axis 20 of the outer case. It is also preferred to arrange the upper and lower support means 34 and 35 on opposite sides of the outer cases 29 in the form of upwardly-directed integral bosses 36 and 37 which are spatially disposed on the upper surfaces of the outer cases and downwardly-directed integral bosses 38 and 39 which are spatially disposed on the lower surfaces of the outer cases. As best seen in FIG. 5, the upper bosses 36 and 37 are respectively shaped to define flat abutment surfaces 40 and 41 lying in parallel transverse planes which are parallel to the longitudinal axis of the charge case 29. Similarly, the lower bosses 38 and 39 are respectively arranged with flat abutment surfaces 42 and 43 lying in separate parallel transverse planes which are below the axis 20 and also parallel to the axis as well as to the transverse planes passing through the upper abutment surface 40 and 41.

It will be noted that the upper and lower bosses 37 and 39 are respectively located just behind the forward end of each of the outer cases 29 and are laterally offset by only a short distance in relation to the central longitudinal axis 20 of the case. Conversely, the upper and lower bosses 36 and 38 are each located well behind the forward ends of the outer cases 29 and are laterally offset by a greater distance in relation to the longitudinal axis 20 of the case. With this configuration of the upper and lower bosses 36–39, it will be appreciated that each of the outer cases 29 will be firmly supported within the stack of charges 11 in the assembly 12 and adequately restrained against being misaligned with respect to their respective blind bores 16. It should also be realized that the vertical height of each of the rearward bosses 36 and 38 must be coordinated to achieve a desired vertical spacing between the cases 29 in one stacked structure, as at A, and the adjacent cases in another stacked structure as at B. On the other hand, the vertical height of each of the forward bosses 37 and 39 must be coordinated to achieve a desired spacing between the adjacent cases 29 in the same stacked structure as at A, B or C. For instance, as best seen in FIG. 1, it should be recognized that the combined heights of the rearward bosses 36 and 38 determines the vertical spacing between the longitudinal axis 20 of the case A1 and the longitudinal axis 20 of the adjacent case C1. Similarly, the combined heights of the rearward boss 36 on the case C1 and the rearward boss 38 on the case B2 (neither boss seen in FIG. 1) will determine the vertical spacing between the longitudinal axis of these two outer cases.

Although this relationship is not evident form FIG. 1, it will be appreciated that the overall height of the rearward bosses 36 and 38 will similarly determine the vertical spacing between the cases 29 in the structure C and the outer cases in the stacked structure B as well as the spacing between the outer cases in the stacked structure B and those in the structure A. On the other hand, it will be realized from FIG. 1 that the combined vertical height of the forward bosses 37 and 39 on the outer cases A1 and A2 controls the vertical spacing between those cases 29. Likewise, the combined height of the forward bosses 37 and 39 will also determine the vertical spacing between the central axes 20 of the cases 29 in the stacked structure B as well as the vertical spacing between the axes of the outer cases in the stacked structure C. It will, of course, be recognized from FIG. 1 that the heights of each of these several bosses 36–39 must be coordinated in accordance with the maximum diameter of the forward portions of the outer cases 29 as well as the diameter of the rearward frustoconical portions of these cases at the nearest points of contact between the adjacent outer cases. Those skilled in the art will, therefore, appreciate that for a given inside diameter of the carrier 13, consideration must be given to the diameter and overall length of the particular shaped charges 11 that are to be used in the carrier to arrive at an optimum size for the charges and a minimum vertical spacing between adjacent charges.

Referring again to FIGS. 4–7, it will be seen that in the preferred embodiment of the outer cases 29 of the invention, alignment means, as shown generally at 44, are arranged on each outer case to maintain them in angular alignment with one another when the intertwined assembly 12 is assembled. In the depicted embodiment of the outer cases 29, the alignment means 44 include interfitting pins, such as at 45 and 46 on the lower bosses 38 and 39 respectively, and sockets, such as at 47 and 48 on the upper bosses 36 and 37 respectively. It will, therefore, be realized that as the several outer cases 29 are being stacked, the pins 45 and 46 on one outer case will be fitted into the mating sockets 47 and 48 in the adjacent cases so that the outer cases will be retained against rotation relative to one another.

Figure 3:
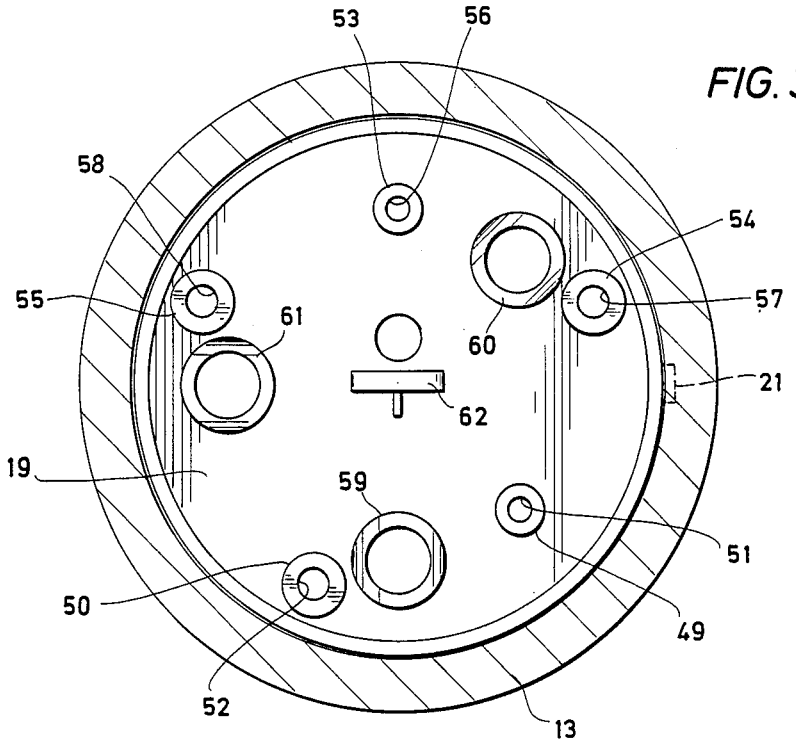
FIG. 3 is a plan view taken along the lines "3—3" in FIG. 1 which depicts a preferred embodiment of a lower base member that is included with the stacked assembly of the shaped charges shown in the drawing.

As best seen in FIG. 1, it will be recognized that to longitudinally offset the several outer cases 29 in each of the stacked structures A, B and C in relation to one another, the lower base member 19 is cooperatively arranged to support the lowermost charge case, as at A1, B1 and C1, in each stacked structure at a different elevation above the base member. Thus, as shown in FIGS. 1 and 3, the lower base 19 includes support means such as laterally-spaced upright posts 49 and 50 that are are located on the base member to be respectively aligned with the lower bosses 38 and 39 on the lower charge case A1 when the case is correctly positioned on top of the base member. Since the lower abutment surface 42 and 43 are at different elevations in relation to the central axes 20, it will be appreciated that the height of the upright posts 49 and 50 must be appropriately arranged to support the outer case A1 in its illustrated position on the lower base member 19. To maintain the lowermost case A1 in proper angular alignment with respect to the lower base member 19, retaining means such as upwardly-directed sockets 51 and 52 are appropriately arranged in the upper portions of the posts 49 and 50 for respectively receiving the depending pins 45 and 46 on the outer case. In a similar fashion, a second set of posts 53 and 54 are located on the lower base 19 to be in alignment with the lower bosses 38 and 39 on the outer charge case B1 and a another post 55 is located on the base to be in alignment with the outer case C1. The other side of the case C1 is supported on the adjacent side of the case A1. It should be understood that the lengths of the posts 53–55 are respectively arranged so as to position the charge cases B1 and C1 at the appropriate elevations above the base member 19. Sockets 56–58 are also respectively arranged in the upright posts 53–55 for retaining the charge cases B1 and C1 in angular alignment on the base member 19.

Those skilled in the art will, of course, recognize that even under the best of conditions, the perforating apparatus 10 will be subjected to substantial impact forces as it is being positioned in a well bore. Accordingly, to be certain that the stacked structures A, B and C are well supported against such impact forces, additional upright posts 59–61 are cooperatively arranged on the lower base member 29 for respectively engaging the lower surfaces of the lowermost charge cases A1, A2 and A3. For similar reasons, it will also be noted in FIG. 3 that a fourth upright 62 is located near the center of the lower base member 19 and, as shown by dotted lines in FIG. 1, arranged to engage a flat horizontal surface, as shown at 63 in FIGS. 6 and 7, on the underside of the axial projection 31 on the lower most charge case A1. Similarly, to provide additional support for all of the inner cases 27 in the intertwined assembly 12, a flat horizontal surface, as at 64, is also cut on the upper side of the projections 31; and the vertical spacing between these upper and lower surfaces on a given axial projection is cooperatively arranged so that when the inner cases are inserted into the outer cases 29, the opposing surfaces 63 and 64 on adjacent inner cases will rest upon one another to provide additional support in the center of the intertwined assembly 12 against vertical movement of the charges 11 in relation to the carrier 13.

Figure 2:
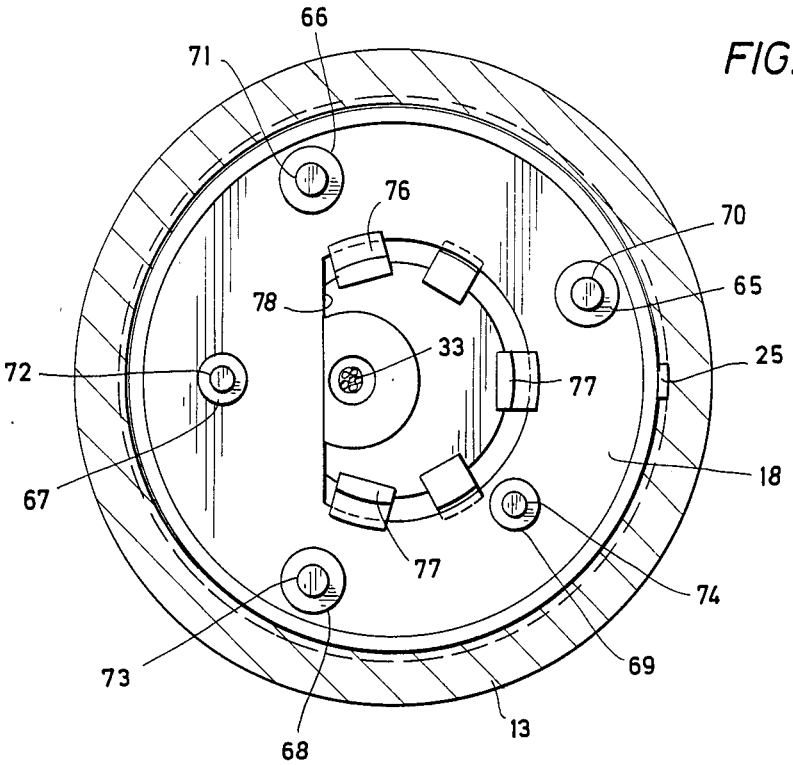
FIG. 2 is a plan view taken along the lines "2—2" of FIG. 1 and depicts a preferred embodiment of an upper base member that is included with the stacked assembly of the shaped charges shown in that drawing.

As best seen in FIGS. 1 and 2, the upper end of the intertwined assembly 12 is capped with the upper base member 18 which is similar to the lower base member 19 and has a series of depending posts 65–69 that are cooperatively positioned on the upper member so as to be respectively aligned with the upper bosses 36 and 37 on these uppermost cases in the intertwined assembly 12. Since the uppermost charge cases An, Bn, and Cn are each at a different elevation relative to one another, it will, of course, be recognized that the posts 65–69 must be arranged with different lengths as needed to reach their associated upper abutment surfaces 40 and 41. As seen in FIG. 2, the depending post 65–69 are also respectively provided with axial pins , as at 70–74, for being received within the matching sockets 47 and 48 in the uppermost charge cases An, Bn and Cn.

Those skilled in the art will, of course, appreciate that it is not always possible to arrange the several mating pins and sockets, as for example at 45–48, 51, 52, 56–58 and 70–74 to be snugly fitted. Accordingly, as is typical, it is preferred to provide some common type of detent means such as an inwardly-opening annular recess around each socket and a mating enlarged-diameter ridge around each pin which are respectively sized to be mated with one another and provide some measure of restraint to guard against inadvertent separtation of the matching elements.

To assembly the intertwined assembly 12, the requisite number of outer cases 29 are successively stacked on top of one another as well as the lower base member 19 in the manner shown in FIG. 1. It should be recognized that as one advantage of the unique assembly 12, it is immaterial whether the inner cases 27 carrying the explosive components of the shaped charges 11 are in the outer cases 29 as the outere cases are being assembled or if the charges are subsequently placed in their respective outer cases. Accordingly, those skilled in the art will appreciate that the new and improved intertwined assembly 12 can be easily assembled as needed for installation in a carrier 13 of a given length. The inner cases 27 of the charges 11 can be initially installed in some or all of the outer cases 29 and changed later with a minimum of difficulty without having to disassemble the intertwined assembly 12 or disturb the detonating cord 33 should this be needed to perform a given perforating opertion. It will, of course, also be appreciated that the arrangement of the several slots 32 will permit the inner cases 27 to be easily installed and removed from the intertwined assembly 12 without disturbing the detonating cord 33.

To complete the assembly of the perforating apparatus 10, a generally-cylindrical upright member 70 is cooperatively arranged to be mounted on top of the upper base member 18. Side-by-side paralleled longitudinal bores 71 and 72 are arranged in the upright member 70 and coopertively sized for respectively receiving typical detonators 73 and 74 and securing them in a side-by-side relation. The parallel bores 71 and 72 are either separated by a thin wall or there is a opening communicating the bores to be certain that the detonation of the detonator 74 will efficiently detonate the detonator 73. Thus, by crimping the detonator 73 on the upper end of the detonating cord 33, the detonation of the side-by-side detonators 73 and 74 will actuate the perforating appartus 10. It will, of course, be recoginized that depending upon the manner in which the perforating apparatus 10 is suspended, the detonator 74 will be appropriately selected so as to be either electrically actuated or actuated by impact. Moreover, should the depicted carrier 13 be suspended from other similar carriers (not illustrated in the drawings), the detonator 74 can also be crimped to the lower end of another length of detonating cord as at 75 that is disposed in the next-higher carrier. It should be noted in passing that although the upright member 70 could be an integral part of the upper base 18, it is preferred to make the member 70 separate from the upper base and provide the upright member with a plurality of flexible depending fingers, as at 76, having outwardly-enlarged heads, as at 77, which are cooperatively positioned to pass through an opening 78 in the upper base member 18 and be biased outwardly to grip the underside of the upper base and thereby secure the upright member 70 thereon.

Accordingly, it will be appreciated that the new and improved perforating appartus of the invention is cooperatively arranged so that it can be readily assembled and disassembled for installation into a typical end-loaded carrier. By virture of the unique arrangement of the several outer cases that respectively support a selected number of shaped explosive charges, these outer cases can be readily assembled in a unique interlocking or intertwined assembly of the charges that can be positioned in the carrier and reliably aligned so as to be fired along selected perforating axes. Moreover, by virtue of the unique design of the new and improved perforating apparatus of the invention, even though the intertwined assembly of outer cases has been completed the shaped charges can be easily installed or removed as needed without disturbing the intertwined assembly.

While only a particular embodiment of the invention has been shown and described, it is apparent that various changes and modifications may be made with departing from the principles of the present invention in its broader aspects; and, therefore, the aim in the appended claims is to cover all such changes and modifications as fall within the true spirit and scope of this invention.

What is claimed is:

1. Perforating apparatus comprising: at least one group of three substantially-identical charge cases with each of said charge cases respectively defining a forwardly-opening cavity around a central axis adapted to receive a shaped explosive charge that is cooperatively arranged to produce a perforating jet along said central axis;

upper and lower support members aligned with one another along an upright longitudinal axis and respectively positioned above and below said charges cases;

lower support means defining downwardly-facing abutment surfaces on opposite sides of each of said charge cases and in transverse planes lying below their respective central axes and upwardly-facing abutment surfaces at circumferentially-spaced locations on said lower support member cooperatively arranged for supporting each of said charge cases at successively higher positiones above said lower support member;

upper support means defining upwardly-facing abutment surfaces on opposite sides of each of said charge cases and in transverse planes lying above their respective central axes and downwardly-facing abutment surfaces at circumferentially-spaced locations on said upper support member cooperatively arranged for supporting each of said charge cases in their successively higher positions above said upper support member; and alignment means cooperatively arranged on said upper and lower support means for retaining each of said charge cases facing outwardly from said longitudinal axis with said central axes respectively directed in a different radial direction.

2. The perforating apparatus of claim 1 further including a shaped explosive charge respectively disposed in each of said cavities.

3. The perforating apparatus of claim 1 wherein said alignment means include mating sets of upwardly and downwardly-facing openings and projections laterally separated from one another on opposite sides of each of said charge cases.

4. The perforating apparatus of claim 3 wherein said openings and projections are complemental bores and pins.

5. The perforating apparatus of claim 1 wherein said transverse planes of each charge case are parallel to said central axis of that charge case.

6. The perforating apparatus of claim 5 wherein said alignment means include complemental bores and pins respectively arranged along axes that are perpendicular to said transverse planes.

7. The perforating apparatus of claim 1 wherein each of said charge cases has a generally-cylindrical forward portion and a a frustoconical rearward portion so that said alignment means are retaining each of said charge cases with their generally-cylindrical forward portions facing outwardly from said longitudinal axis and said frustoconical rearward portions of said three charge cases spatially disposed over one another when said charge cases are in their said successively higher positions above said lower support member.

8. The perforating apparatus of claim 7 further including an axially-aligned opening in said frustoconical rearward portion of each of said charge cases; a shaped explosive charge respectviely disposed in each of said cavities and having a rearward extension projecting through said axial opening of its associated charge case; and means defining abutting surfaces on said rearward extensions adapted to be coengaged with one another when said charge cases are in their said successively higher positions above said lower support member.

9. The preforating apparatus of claim 8 including means on each of said rearward extensions adapted for securing detonating means in detonating proximity of said shaped explosive charge.

10. Perforating apparatus comprising:

first, second and third groups of charge cases having cylindrical forward portions and frustoconical rearward portions respectively defining a forwardly-opening cavity around a central axis adapted to receive a shaped explosive charge cooperatively aranged to produce a perforating jet along said central axis;

upper and lower support members aligned with one another along an upright longitudinal axis and respectively positioned above and below said charge cases and including means for cooperatively securing said charge cases in said three groups at successively higher positions above said lower support member with their said rearward portions adjacent to said upright longitudinal axis and said forward portions facing laterally outwardly;

support means defining matching upwardly and downwardly-facing abutment surfaces on opposite sides of each of said charge cases lying in matching transverse planes above and below the central axis of each of said charges cases;

mating upwardly and downwardly-facing alignment means laterally spaced from one another on opposite sides of each of said charge cases and cooperatively arranged so that as said downwardly-facing abutment surfaces on one of said charge cases in a given group are respectively coengaged with an upwardly-facing abutment surface on the opposite side of another charge case in that same group as well as with an upwardly-facing abutment surface on the same side of a charge case in another group, opposed sets of said alignment means will be mated to retain those charge cases in a fixed relationship relative to one another whereby said charge cases can be progressively erected to provide an intertwined assembly of said charge cases spiraling around said upright longitudinal axis with their said frustoconical rearward portions nestled together in an overlaping relationship and said central axis of each of said charge cases directed laterally outwardly in a selected radial direction.

11. The perforating apparatus of claim 10 wherein said central axes of said charge cases are directed at equal angles to one another.

12. The perforating apparatus of claim 10 further including a shaped explosive charge respectively disposed in each of said cavities.

13. The perforating appartus of claim 10 wherein said alignment means include mating sets of upwardly and downwardly-facing openings and projections laterally separated from one another on opposite sides of each of said charge cases.

14. The perforating appartus of claim 13 wherein said openings and projections are complemental bores and pins.

15. The perforating apparatus of claim 10 wherein said transverse planes of each charge case are parallel to one another as well as to said central axis of that charge case.

16. The perforating apparatus of claim 15 wherein said alignement means include complemental bores and pins respectively arranged along axes that are perpendicular to said transverse planes.

17. The perforating appartus of claim 10 wherein said charge cases are fabriated from a thermoplastic material.

18. The perforating apparatus of claim 10 further including an axially-aligned opening in said frustoconical rearward portion of each of said charge cases; a shaped explosive charge respectively disposed in each of said cavities and having a rearward extension projecting through said axial opening of its associated charge case; and means defining abutting surfaces on said rearward extensions adapted to be coengaged with one another when said charge cases are in their said successively higher positions above said lower support member.

19. The perforating apparatus of claim 18 including means on each of said rearward extensions adapted for securing detonating means in detonating proximity of said shaped explosive charge.

20. The perforating apparatus of claim 18 including a tubular carrier disposed around said intertwined assembly of charge case and adapted to be suspended in a well bore.

21. The perforating apparatus of claim 10 further including a shaped explosive charge respectively disposed in each of said cavities; detonating means including a detonating cord disposed inside of said intertwined assembly of charge cases along said longitudinal axis and in detonating proximity of said shaped explosive charges; and a tubular carrier cooperatively disposed around said intertwined assembly of charge cases and adapted to be suspended in a well bore.

* * * * *